United States Patent [19]

Osaka et al.

[11] 4,427,048

[45] Jan. 24, 1984

[54] SHUTTER CONSTRUCTION

[75] Inventors: Susumu Osaka; Minoru Toda, both of Machida, Japan

[73] Assignee: RCA Corporation, New York, N.Y.

[21] Appl. No.: 231,858

[22] Filed: Feb. 5, 1981

[30] Foreign Application Priority Data

Sep. 2, 1980 [GB] United Kingdom ..... 8028238

[51] Int. Cl.[3] ..... E06B 7/086

[52] U.S. Cl. ..... 160/107; 49/64; 160/236

[58] Field of Search ..... 160/107, 236, DIG. 17; 52/200, 790; 49/64, 88, 89, 90, 74

[56] References Cited

U.S. PATENT DOCUMENTS

| | | | |
|---|---|---|---|
| 11,311 | 7/1864 | Ward | 160/236 |
| 49,167 | 8/1865 | Stetson | 52/790 |
| 478,563 | 7/1892 | Brown | 49/88 |
| 1,403,054 | 1/1922 | Nabers | 49/88 X |
| 1,978,152 | 10/1934 | Ward | 160/DIG. 17 |
| 2,146,816 | 2/1939 | Grassby, Jr. | 156/17 |
| 2,276,425 | 3/1942 | Slattery | 156/17 |
| 2,300,545 | 11/1942 | Gouch | 160/178 |
| 2,545,631 | 3/1951 | Ribley | 160/107 |
| 2,546,335 | 3/1951 | Friend | 88/57.5 |
| 3,032,099 | 5/1962 | Croxen | 160/168 |
| 3,106,240 | 10/1963 | Weber | 160/236 |
| 3,110,824 | 11/1963 | Flanagan | 310/8.5 |
| 3,177,367 | 3/1965 | Brown | 250/237 |
| 3,211,264 | 10/1965 | Streeter, Jr. | 160/107 |
| 3,265,117 | 8/1966 | Lorentzen et al. | 160/174 |
| 3,294,608 | 12/1966 | Peterson | 52/223 R |
| 3,342,244 | 9/1967 | Streeter, Jr. | 160/107 |
| 3,860,055 | 1/1975 | Wild | 160/1 |
| 3,872,911 | 3/1975 | James | 160/1 |
| 3,881,539 | 5/1975 | Falgas | 160/107 |
| 3,971,427 | 7/1976 | Coldewey et al. | 160/166 R |

FOREIGN PATENT DOCUMENTS

| | | | |
|---|---|---|---|
| 1086031 | 7/1960 | Fed. Rep. of Germany | 49/64 |
| 584327 | 1/1977 | Switzerland | 52/200 |

*Primary Examiner*—Peter M. Caun

*Attorney, Agent, or Firm*—Joseph S. Tripoli; Robert L. Troike; William Squire

[57] ABSTRACT

A shutter for a skylight or a window comprises a transparent housing and a shutter assembly within the housing. The shutter is formed of louvres comprising light weight S-shaped reinforced foil members pivoted at their ends with light weight pivot pin bearings. A counterbalanced crank arm rotates the louvres by way of one of the pivot bearings.

10 Claims, 16 Drawing Figures

Figure 1:
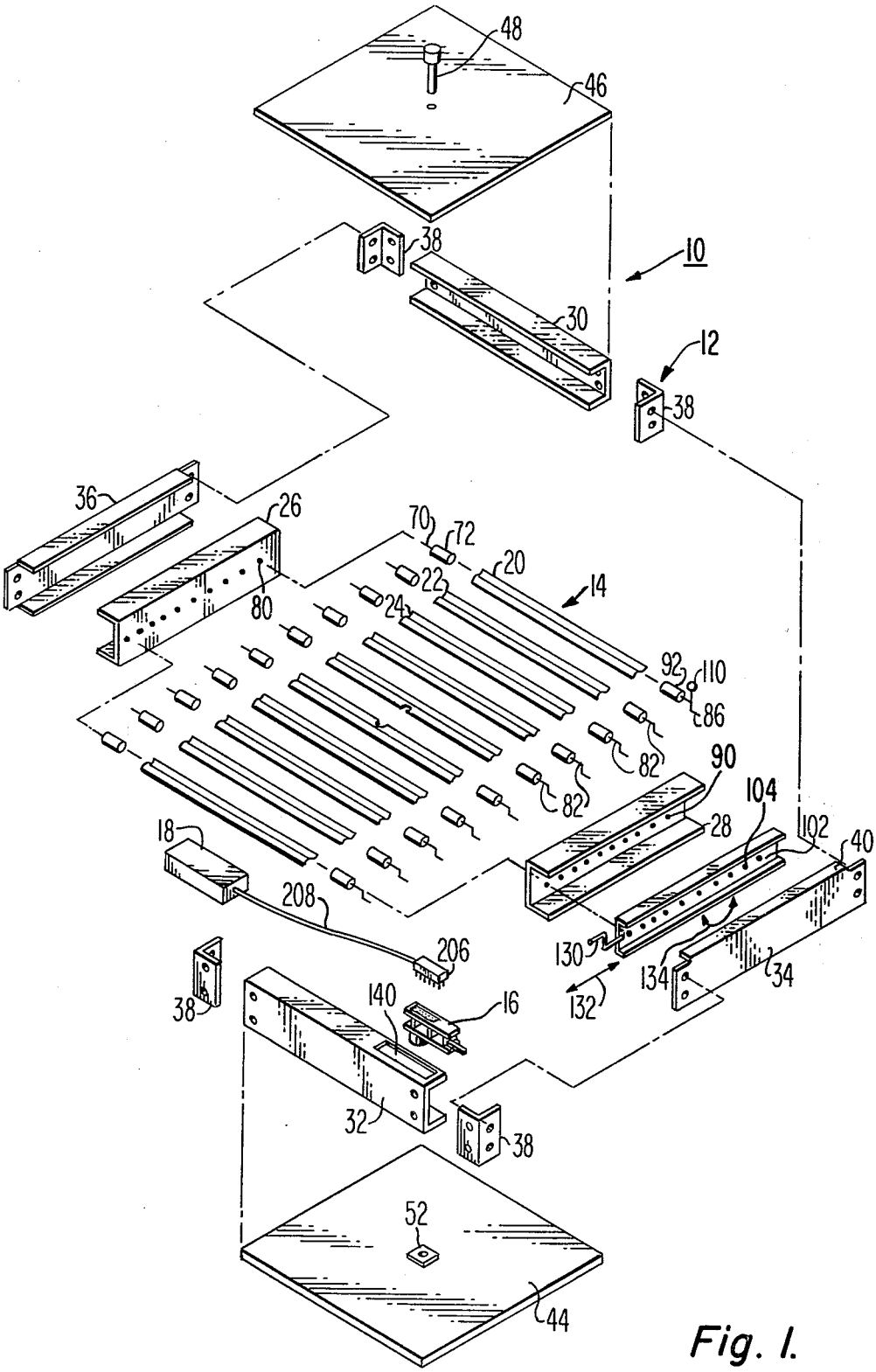

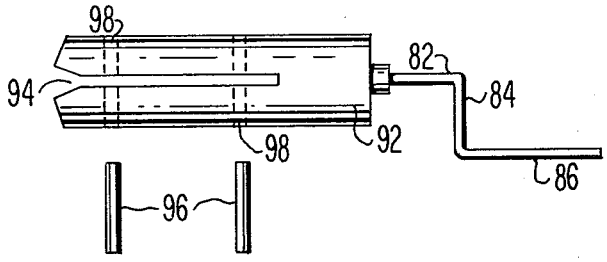
Fig. 6.
Fig. 7.
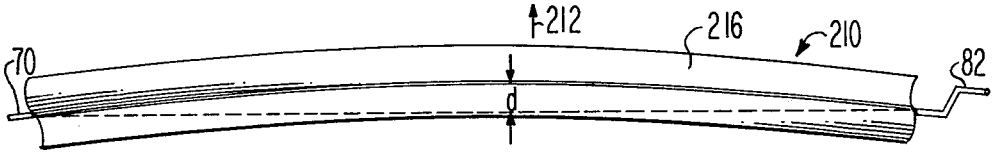
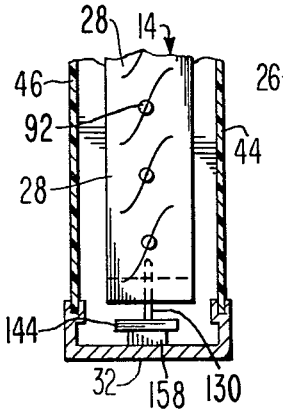
Fig. 9.
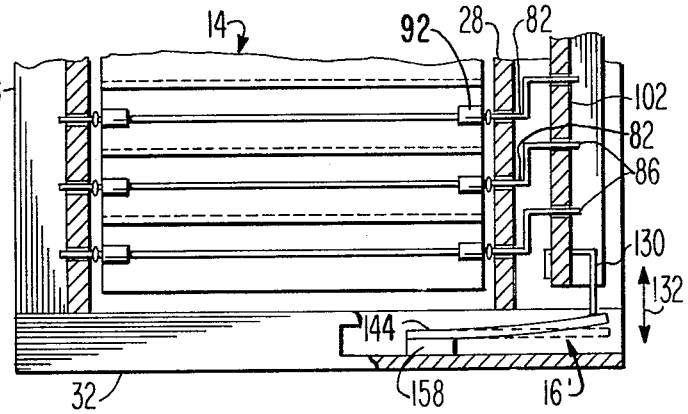
Fig. 8.

SHUTTER CONSTRUCTION

The present invention relates to shutter apparatus.

Of interest is copending application (RCA 74,144) entitled "Venetian Blind Construction" by Susumu Osaka and Midori Sagawa, filed concurrently herewith and assigned to the assignee of this invention.

Shutter apparatuses presently in the use employ relatively bulky mechanisms for opening and closing the louvres. These structures are relatively cumbersome to operate and may require relatively large power drive systems. Such apparatus do not readily lend themselves to operation by low power sources, such as solar cells and batteries.

According to an embodiment of the present invention, a shutter construction comprises a plurality of S-shaped foil louvres. A bearing is on one end of each louvre and a crank on the other end and aligned with the bearing of that louvre forming a louvre pivot axis. Bearing means which rotatably receive each of the bearing and cranks also restrain the louvres in a direction along the axes. Drive means are coupled to the cranks and offset from the axes for simultaneously rotating the louvres about the axes and includes counter balance means for counter balancing the drive means about the axis during rotation.

Figure 2:
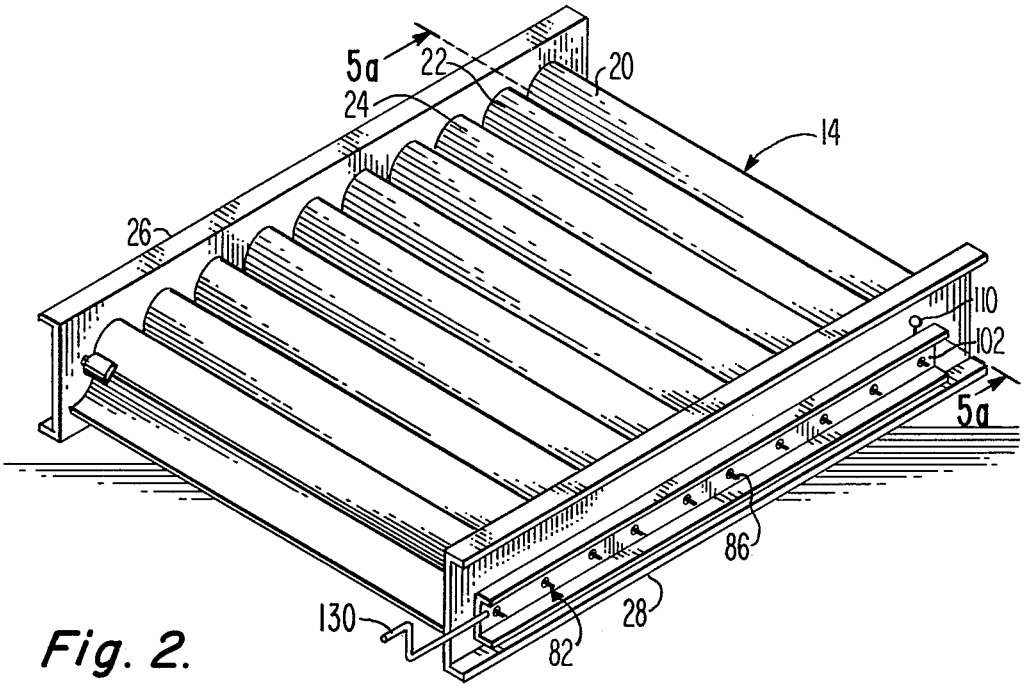
Figure 3:
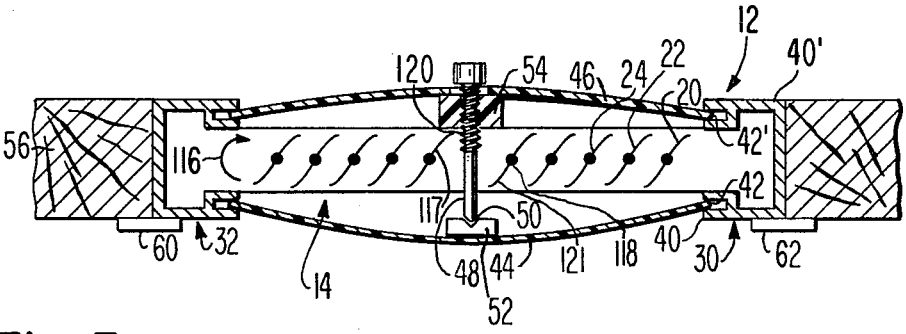
Figure 4:
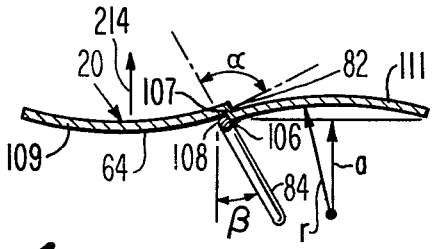
Figure 5B:
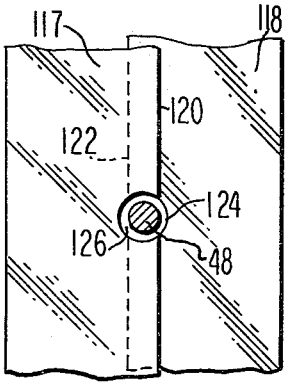
Figure 4A:
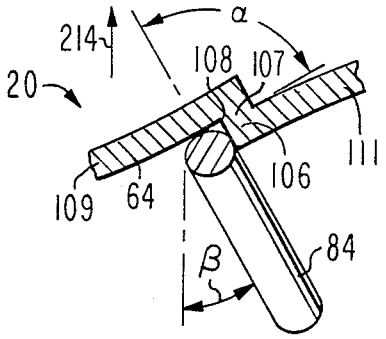
Figure 5A:
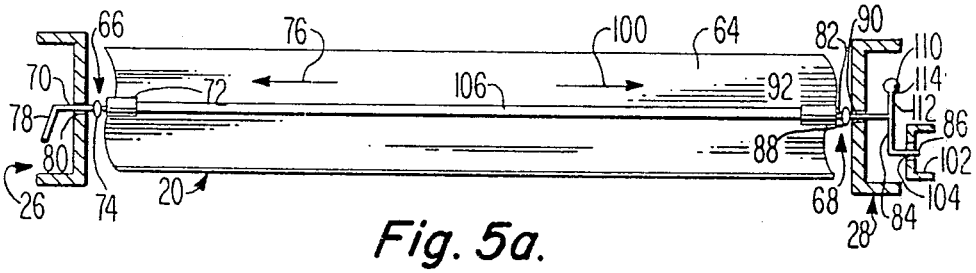
Figure 10:
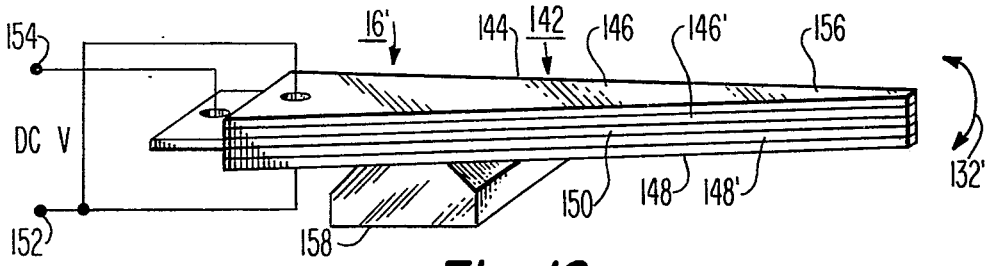
Figure 11:
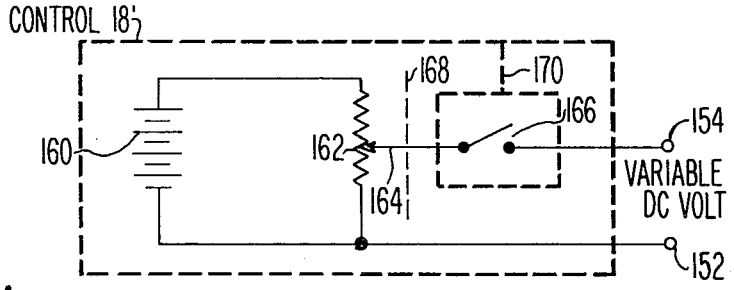
Figure 12:
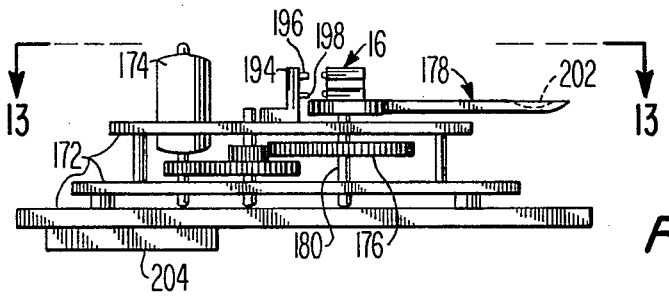
Figure 13:
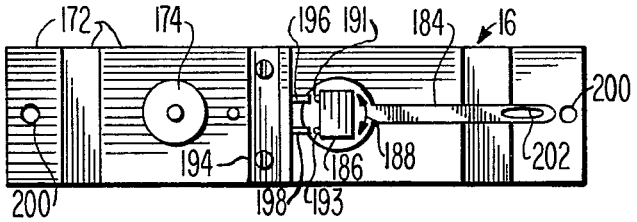
Figure 14:
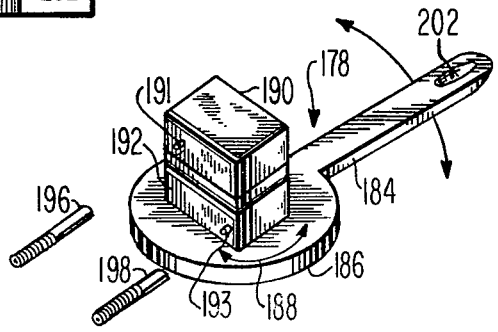

In the drawing:

FIG. 1 is an exploded isometric view of a shutter construction embodying the present invention, FIG. 2 is an isometric view of a portion of the construction of FIG. 1 showing the louvre assembly, FIG. 3 is a sectional view of a shutter construction embodying the present invention, FIG. 4 is an end view illustrating a typical louvre shape and orientation of its crank pin, FIG. 4*a* is a fragmented sectional view showing the central portion of the louvre of FIG. 4, FIG. 5*a* is a sectional view of the apparatus of FIG. 2 taken along lines 5*a*—5*a*, FIG. 5*b* is a plan view of the centrally located louvres showing their relationship to the housing support at the center of the assembly, FIG. 6 is a side elevation view of a typical crank pin used to drive a louvre, FIG. 7 is an isometric view of an alternate embodiment of a louvre employed in the construction of FIG. 1, FIG. 8 is a partially diagrammatic front elevation view illustrating one drive mechanism for operating the louvres, FIG. 9 is a side sectional view of the assembly of FIG. 8, FIG. 10 is an isometric view of a bimorph drive device employed in the embodiment of FIGS. 8 and 9, FIG. 11 is a circuit schematic diagram employed as a control for operating the bimorph device of FIG. 10, FIG. 12 is a side elevation view of a drive module employed in the embodiment of FIG. 1, FIG. 13 is a plan view of the module of FIG. 12 taken along lines 13—13, and FIG. 14 is an isometric view of part of the drive module of FIGS. 12 and 13.

In FIG. 3, shutter assembly 10 comprises a housing 12 (the walls 44 and 46 of which are transparent) which encloses a louvre module 14. The louvre module 14 comprises a plurality of louvres 20, 22, 24 and so on, secured between two elongated channel members 26 and 28 as shown in FIGS. 1 and 2. Drive module 16, FIG. 1, is attached to the housing 12 and is operated by control 18. The module 14 louvres do not touch the housing walls which provide a dust-proof, construction. The entire assembly can be easily transported as a portable cassette unit. Further, it is relatively maintenance free and has prolonged life in that the louvres are protected from damage and dirt. The shutter assembly is especially adapted for use in a horizontal orientation as shown in FIGS. 2 and 3 for use with a skylight installed in a ceiling or roof of a building.

The housing 12, FIG. 1, comprises channel members 30, 32, 34 and 36 which form the edges of assembly 10 and transparent sheets 44 and 46 which complete the enclosure. The channel members are secured to one another by L-shaped connectors 38. In FIG. 3, the inwardly facing edges of the legs of each of the channel members, for example, legs 40, 40' of member 30, terminate in channels such as channels 42, 42', respectively, for receiving transparent sheets 44, 46, respectively. Sheets 44 and 46 form a completely enclosed housing with the channel members 30, 32, 34 and 36. Sheets 44 and 46 may be thermoplastic material, glass or any other transparent sheet material which is sufficiently stiff to be self-supporting. By making the sheets 44 and 46 of relatively thin thermoplastic material, they may sag slightly when deployed in a horizontal orientation due to their own weight. An adjustable spacer rod 48 illustrated in FIG. 3 may be employed to prevent such sagging.

The spacer rod 48 may comprise a conventional screw which abuts at end 50 against block 52 secured to the inner surface of sheet 44. Threaded nut 54 is secured to the inner surface of sheet 46. The rod 48 is threaded to the nut 54 to bow out the sheets 44 and 46 as shown, and to support them, in this position, at the central regions, thereby preventing them from sagging. The sheets are spaced from the louvre module 14.

In FIG. 5*a*, typical louvre 20 comprises a louvre slat 64 secured between channel members 28 and 26 by respective bearings 66 and 68. Bearing 66 includes a small diameter pin 70 which may be 0.3–0.4 mm diameter steel piano wire. Pin 70 passes through a bearing aperture 80 in the channel member 26. Pin 70 is secured to connector 72 attached to slat 64. A glass bead 74 secured to pin 70 limits the motion of slat 64 in direction 76 toward member 26. Bead 74 is larger than aperture 80 and serves as a bearing surface should the louvre slide in the direction 76 against channel member 26. Connector 72 may be a thermoplastic member, or in the alternative, may be an epoxy bead for cementing pin 70 to slat slat 64. Pin 70 may be bent at 78 to further secure it to channel member 26.

Bearing 68 at the other end of slat 64 comprises a pin 82 which maybe made of the same material as pin 70 and bent into a crank having a drive arm 86. The pin 82 passes through aperture 90 in the channel member 28. Aperatures 80 and 90 lie in the axis of rotation of the louvre. A glass bearing bead 88 is attached to pin 82 between slat 64 and channel member 28. Bearing 68 is shown in more detail in FIG. 6. In FIG. 6, pin 82 is mounted within a thermoplastic connector 92 which has a slot 94 for receiving slat 64. Wedge pins 96 are inserted in apertures 98 puncturing the slat 64 which is an extremely thin foil, as will be explained, securing connector 92 to slat 64. Connector 72 at the other end of the slat may be constructed similarly. Bead 88 is larger than the aperture 90 and serves as a bearing against member 28 should the slat move in the direction 100. Crank drive member 102 which is an elongated channel member has apertures 104 for receiving the drive arms 86 of pins 82 of each louvre. All of the louvres are similarly constructed and mounted.

In FIGS. 4 and 4*a*, the louvre 20 slat 64 has a somewhat S-shape with a V-shaped rib or bend 106 running the entire length of the slat 64 between pins 70 and 82. The bend 106 comprises a relatively short centrally positioned leg 107 interconnecting two like slat sections 109, 111. Leg 107 is normal to sections 109, 111 at the point where connected to them. The leg 107 and the interconnected section surfaces thus forms V-shaped grooves, such as at 108. Each section 111, 109 is thus spaced from each other by the extent of leg 107. The bend 106 serves to reinforce the slat and prevent it from sagging in the central region due to its own weight. Also bend 106 is important for locating the slat axis of rotation. The angle $\alpha$ of the bend 106 is preferably about 90° and could vary somewhat from this. The V-shaped bend 106 serves as a convenient locating point for the pins 70 and 82, FIG. 5*a*. The crank arm 84 of pin 82 extends from the central bend 106 at an angle $\beta$ which, by way of example, may be about 45° from the vertical when the slat is oriented horizontally. All louvres are constructed similar to louvre 20. However, louvre 20 also has secured thereto a counterbalance 110, FIG. 5*a*. There is a single counterbalance 110 attached to the entire system. This counterbalance is attached to any one louvre, louvre 20 by way of example. Counterbalance 110 comprises a stiff wire 112 and a mass 114 secured to the extended end of wire 112. The wire 112 and mass 114 extend from pin 82 in a direction opposite to that of the crank arm 84 to counterbalance crank drive member 102 about the axis of rotation of louvre 20 formed by pins 70 and 82. The counterbalance 110 could be attached to any one of the pins 82.

As the louvres are rotated about pins 70 and 82 in the direction 116, FIG. 3, crank drive member 102, FIG. 5*a*, is lifted in the vertical direction to a higher position (not shown). The counter balance 110 is dropped a corresponding distance and provides an equilibrium about the axis of rotation of pins 70 and 82. As a result of this balancing, a very low drive force is required to torque all of the louvres about their respective axes. Also, when the slats are very thin foil and thus lightweight, member 102 has a weight which tends to bias the louvres in a given orientation. The counterbalance overcomes this problem.

The bearing apertures 80 in channel member 26 are equally spaced from each other a given distance sufficient so that the slats 64, FIG. 5*a*, overlap each other somewhat in a closed position. The apertures 90, 104 in the channel member 28 and crank drive member 102, respectively, are all spaced substantially the same distance apart as are the corresponding apertures 80 in channel member 26. These apertures are slightly larger than the respective bearing pins 70 and 82 to permit free movement between the bearings and the apertures.

The slats 64, FIG. 5*a*, are formed from aluminum alloy, preferably having a thickness of 30–50 microns and molded by hot pressing into the shape of FIG. 4. The slats are symmetrical about their longitudinal centers. To preclude distortion of the slats from the shape of FIG. 4 along their entire length and prevent twisting, the mold or dyes used to press the slats are heated and the aluminum foil forming the slats is annealed during pressing. The annealing process releases pleats which may be present in the foil to produce a smooth surface. If the annealing temperature and time are excessive, the elastic yield point becomes very small so that the material is easily deformed during handling. Therefore, the annealing should be limited to a desirable range of temperatures and time. Another factor involved in forming the slats is the shape factor which refers to the degree that the shape of the slat of FIG. 4 actually conforms to the shape of the mold. A shape factor of 100% means that the shape of the resulting slat is identical to that of the mold. The shape factor increases with temperature and time. To increase productivity rate, the shortest annealing time is desirable; however, the shape factor tends to become smaller. When the shape factor is small, the slat is easily elastically deformed by external force or by its own weight. The condition of 200° C. annealing temperature and a 3 second molding time, produces a 53% shape factor. A 53% shape factor for a slat described below does not incur a central displacement or sag of the slat by self weight; therefore, this condition is most desirable. The above shape factor of 53%, 200° C. annealing condition and 3 second molding time, are for a 50 micron thick slat having a 4 centimeter width, a 45 centimeter length, a weight of 1.82 grams and supported at its ends as illustrated in FIG. 5*a*, and 100% shape factor corresponds to r-a=0.55 cm (a=0.6 cm, and r=1.15 cm) in FIG. 4, where r is the radius of curvature of each half of the slat.

The force required to rotate the louvres, which are ideally balanced, is comprised of two parts. One is a force to overcome static friction, $f_s$, and the other is a force $f_t$ to turn those slats having gravity sag (bending of the slat due to gravity). The gravity sag force is similar to the necessary force to tilt a pendulum of a clock, but the arm length varies with the tilt angle since the gravity sag of the slat is different at different angles. The gravity sag force is a minimum at the vertical position of the slats where the sag is a minimum. Accordingly, the total frictional force is given by $$f_s = 0.36GR/L,$$

where 0.36 is frictional coefficient between the aluminum bearings of the channel members and the steel bearing pins, G is the total weight of the slats, R is radius of the steel wire pins 70 and 72, and L is length of the crank arm 84. The driving force to turn the slats against sag is $$f_t = 0.32\Delta yGL^{-1}\sin 2\theta,$$

where $\Delta y$ is gravity sag at the center of the slat and $\theta$ is tilt angle of the slat, ($\theta=0$, for horizontal position). The quantity $f_t$ shows a maximum at $\theta=45°$ in our case.

In an embodiment of the invention constructed, the shutter included 14 slats 50 cm long having a radius r of 1.5 cm, a distance a of 1.2 cm, FIG. 4, and a thickness of 40 $\mu$m. These covered $50\times50$ cm$^2$ of array area. For the parameters of G=32.2 grams, 1=0.6 cm, R=0.015 cm, and $\Delta y=51$ $\mu$m, the calculated values for $f_s$ and $f_{t\,max}$ 0.29 grams and 0.088 grams, respectively. The measured force required to drive the slat was found to be in the range of 0.35 grams–1.2 grams depending upon the setting angle of the system (vertical or horizontal). The larger value of the driving force is thought to have been required because of imbalance of the louvre axis position which can be reduced in accordance with a given implementation.

If an array $1\times1$ $m^2$ is designed for use with the same cross-sectional dimension slat structure described above, $f_s$ and $f_t$ max are 1.2 grams and 5.6 grams, respectively. If a $2\times2$ $m^2$ array is used, $f_s$ and $f_t$ are 4.6 grams and 350 grams. Note here that $f_s$ is proportional to the total area, but $f_t$ is proportional to the cube of the total area assuming a square shape of the total array area.

Imbalance due to errors in the axis position always will exist to some degree. But these will be less than proportional to total area (weight). If desired, the imbalance can be cancelled by a counterbalance attach to the slat system at any one of the bearing pins.

Each slat 117 and 118 at the center of the array has a slot or opening formed at its edge 120 and 122, respectively, as shown in FIGS. 1 and 5*b*. Opening 124 is formed at edge 122 of slat 118 and opening 126 is formed at edge 120 of slat 117. The openings 124 and 126 permit the spacer rod 48 to pass between the slats 117 and 118.

The crank drive member 102 includes a bent drive arm 130, FIGS. 1 and 2. This shape is similar to that for the bearing pin 82, FIG. 5*a*. The drive arm 130 is made of relatively stiff steel wire so that it can withstand, without bending, the forces applied in the directions 132, FIG. 1. Forces applied to the drive arm 130 in directions 132 causes circular translation of the crank drive member 102 in the directions 134. This action rotates all the slats in unison about their respective rotation axes formed by the bearing pins 70 and 82 at the bearing apertures 80 and 90 in channel members 26 and 28. The lightweight aluminum sheets of foil forming the louvres add negligible weight to this load. Any imbalance during rotation of the louvres introduced by the weight of the louvres can also be counter balanced by the counterbalance 110. If necessary, the wire 112 may be slightly bent to obtain ideally balanced condition. The small diameter pins 80 and 82, the lightweight aluminum foil forming the louvres, and the pin bearings all contribute to the low friction, low load requirements for rotating the louvres.

Drive module 16 drives the louvres by pushing drive arm 130, FIG. 1, in directions 132. Drive module 16 is releaseably attached by screws, for example, to the channel 32 via module aperture 140. FIGS. 8 and 9 illustrate one form of drive module for driving the crank drive member 102. In FIG. 8, drive module 16' may comprise a bimorph drive assembly 142. The bimorph assembly 142 comprises a triangular bimorph or piezoelectric element 144, FIG. 10, which comprises outer conductor layers 146 and 148. The triangular shape produces maximum mechanical output power per unit volume of bimorph material and therefore is the most economical. Layer 146 is over piezoelectric strip 146' and layer 148 is over piezoelectric strip 148'. The strips 146' and 148' are separated by conductive sheet 150. The layers 146 and 148 are connected to terminal 152 and the center sheet 150 is connected to terminal 154. A DC voltage is applied to the terminals 152 and 154 to bend the element 144 end 156 in vertical directions 132'. The element 144 is supported by block 158 secured to channel member 32, FIG. 9. Element 144 is secured at an end opposite the moving end 156 which drives drive member 102 FIG. 8, via drive arm 130. Displacement of end 156 in the directions 132', FIG. 10, pushes the arm 130 in the linear directions 132, FIG. 8. The arm 130 is connected to the element 144, FIG. 8, by a flexible adhesive or may be mounted via a suitable bearing arrangement.

A circuit for operating the bimorph element 144, FIG. 10, is shown in FIG. 11 and includes a control 18' comprising resistor 162 connected across battery 160. One battery terminal is connected to terminal 152. The tap of the potentiometer is connected to terminal 154 via wiper 164 through switch 166.

In operation, the wiper 164 is moved to change the voltage tapped off the potentiometer by means of a control 168 (dashed line). The switch 166 may be operated by a remote control device illustrated by dashed line 170 to apply the tapped off voltage to the bimorph element.

In FIG. 12, a second embodiment of drive module 16 is shown using a motor and gear arrangement. In FIG. 12, drive module 16 includes a support structure 172 to which is mounted a DC motor 174. Motor 174 drives a set of gears 176 in a gear train to slowly rotate lever assembly 178. In FIG. 14, lever assembly 178 comprises a lever 184 extending from disk 186. The disk 186 is secured to shaft 180, FIG. 12. The shaft 180 rotates the disk and lever of FIG. 14 in the directions 188. Mounted on the disk 186 are two micro switches 190 and 192, one above the other, each with a respective contact element 191 and 193. Mounted on the support structure 172 is stop structure 194, FIGS. 12 and 13, which includes screws 196 and 198 which respectively engage elements 191 and 193 when the disk 186 is rotated in the directions 188. When the disk 186 is rotated counterclockwise, FIG. 14, the switch 190 element 191 contacts screw 196 and this cuts off power to the motor 174, FIG. 12. When the disk 186 rotates clockwise, the contact 193 is engaged by screw 198 and this limits the rotation of the lever 184 in this direction by cutting off power to the motor 174. The support structure 172 is mounted to the channel member 32, FIG. 1, by screws inserted in screw apertures 200.

The lever 184, FIGS. 13 and 14, includes a recess 202 and connecting pin (not shown) for coupling the drive arm 130, FIG. 1, to drive the crank drive member 102. In the alternative, the lever may be secured to the drive arm 130 by a flexible adhesive material.

Secured to the support structure 172, FIG. 12, is a connector assembly 204 which connects power to the motor 174 by wires (not shown). In FIG. 1, control 18 is connected to a connector 206 by cable 208. Connector 206 mates with assembly 204. The control 18 may be a battery or a source of DC voltage operated by a switch for providing power to the motor 174, FIG. 12.

The drive module 16, regardless of its form, is a replaceable modular unit and is inserted in the aperture 140 in channel 32, FIG. 1, and therefore lends itself to a variety of different configurations and can be readily updated in structure and in design without altering the remaining shutter structure. That is, a single shutter structure without the drive module may employ both the bimorph drive system of FIGS. 8, 9 and 10, or the module of FIGS. 12–14 or any other modular system for a particular implementation without altering the basic design configuration of the shutter construction.

Due to the light weight of the louvres and the low friction involved during rotation of the louvers, very low forces may be provided for rotating the louvres. For example, the mechanical power required for driving the louvres in a 1 meter square louvre system to rotate them from one state to another state can be shown to be negligibly small, for example, 2.7 microwatts (1 cycle per sec.). To maintain the position of the louvres in a given state requires a power of 10 $\mu$W.

Thus bimorphs 100×100 square meter louvre system would consume about 6 watts of electrical power.

In FIG. 7, to compensate for gravity sag of the slats, they may be bent slightly a small distance d in the direction 212. This would bend the slat 216, distance d, from its normal position as indicated by the dashed line between the bearing pins 70 and 82 representing the louvre axis of rotation. When in a horizontal position, the bending of the slat distance d can be cancelled by the gravity slag when the slat is oriented horizontal as shown in FIG. 1. That is, the distance d is measured in the vertical direction 214, FIG. 4. Gravity sag bends the slat in the opposite direction. This bend, however, cannot be cancelled in the vertical position of the blade, that is, when the blade of FIG. 4 is rotated 90°. At this position the gravity effect may produce a rotational torque. This torque can be cancelled by small counterweight attached to the bearing pin 82 at the crank arm 84, FIG. 5A.

What is claimed is:

1. A shutter construction comprising:

a transparent housing;

a louvre assembly adapted to be enclosed within said housing, said assembly comprising a plurality of lightweight foil louvres each rotatably supported at its end along parallel axes with first and second bearing pins;

a crank drive member attached to one pin of each louvre for rotating said one pins and said louvres in unison about said parallel axes, said crank drive member and louvres having a combined mass center offset from said axes;

counterbalance means coupled to said drive member for counterbalancing said offset mass center with respect to said axes; and drive means releasably secured to said housing and coupled to said crank drive member for moving said crank drive member in a direction normal to said axes.

2. The construction of claim 1 wherein said housing includes first and second transparent sheets which are supported and held in place at their edges, the sheet being sufficiently thin that they tend to sag when horizontal due to their weight, and brace means located centrally and normal to said sheets for holding the sheets apart in and their center region a distance further than they are spaced along their edges, thereby adding rigidity to the sheets.

3. The shutter construction of claim 1 wherein said drive means includes a motor, a gear train driven by said motor, and a lever rotated by said gear train for operating said crank arm, and motion limit means coupled to said lever for limiting the arc through which the lever rotates.

4. The shutter construction of claim 1 wherein each of said louvres comprise a like longitudinally ribbed generally S-shaped foil of highly reflective material.

5. A shutter construction comprising:

a plurality of foil louvres;

a bearing pin at each end of each louvre, said bearing pins of each louvre being aligned on a given axis;

a crank on one end of each louvre coupled to one of said bearing pins, said crank including a drive arm offset from said given axis;

bearing means for rotatably receiving each said bearing pins including means for restraining said louvres in a direction parallel to their corresponding axes;

drive means including a crank drive member coupled to each said cranks at said drive arm, said drive member having a mass center offset from said axes for simultaneously rotating said louvres about said corresponding axes, said drive member circularly translating during said rotating, said drive member including counterbalance means for counterbalancing said drive member mass center during said rotating.

6. The construction of claim 5 wherein said louvres each include a like reinforcing end bearing locating bend centrally the transverse dimension of that louvre and extending along the length of that louvre.

7. The construction of claim 6 wherein said louvres and bend comprises two louvre sections connected by a relatively short leg approximately normal to the sections at the point where connected.

8. The construction of claim 5 further including a light transparent housing enclosing said louvres.

9. The construction of claim 5 wherein said louvres are normally biased along a curve between said bearing means, said curve at a point midway between said bearing means being offset from the axis of rotation of the corresponding louvres an amount sufficient to compensate for sag of said louvres due to gravity and thereby result in straightening said louvres in the presence of that sag.

10. The construction of claim 5 wherein said drive means includes a drive crank rotatably connected to each said cranks and bimorph drive means connected to said drive crank.

* * * * *